US008149650B2

(12) United States Patent
Olsen

(10) Patent No.: US 8,149,650 B2
(45) Date of Patent: Apr. 3, 2012

(54) WEARABLE ELECTRONIC DEVICE WITH SECONDARY DIGITAL DISPLAY

(75) Inventor: Fred. Olsen, Oslo (NO)

(73) Assignee: Timex Group B.V. (NL)

( * ) Notice: Subject to any disclaimer, the term of this patent is extended or adjusted under 35 U.S.C. 154(b) by 205 days.

(21) Appl. No.: 12/195,473

(22) Filed: Aug. 21, 2008

(65) Prior Publication Data

US 2010/0046328 A1 Feb. 25, 2010

(51) Int. Cl.
*G04C 19/00* (2006.01)

(52) U.S. Cl. ..... 368/84; 368/242

(58) Field of Classification Search ..... 368/223, 368/84, 242

See application file for complete search history.

(56) References Cited

U.S. PATENT DOCUMENTS

| | | | | | |
|---|---|---|---|---|---|
| 3,939,645 | A * | 2/1976 | Charbonney | ..... | 368/35 |
| 4,236,239 | A * | 11/1980 | Imgruth et al. | ..... | 368/72 |
| 4,444,513 | A | 4/1984 | Proellochs et al. | | |
| 4,470,707 | A * | 9/1984 | Chambon et al. | ..... | 368/74 |
| 4,726,687 | A | 2/1988 | Gander | | |
| 4,985,878 | A | 1/1991 | Yamada et al. | | |
| 5,050,138 | A * | 9/1991 | Yamada et al. | ..... | 368/10 |
| 5,138,590 | A * | 8/1992 | Masuda et al. | ..... | 368/10 |
| 5,262,763 | A * | 11/1993 | Okuyama et al. | ..... | 345/87 |
| 5,479,381 | A * | 12/1995 | Goldenberg et al. | ..... | 368/282 |
| 5,790,477 | A | 8/1998 | Hauke | | |
| 6,580,664 | B2 | 6/2003 | Magnusson | | |
| 6,779,917 | B1 * | 8/2004 | Chappuis | ..... | 368/282 |
| 2005/0094492 | A1 | 5/2005 | Rosevear | | |
| 2006/0034161 | A1 * | 2/2006 | Muller | ..... | 368/281 |
| 2007/0008829 | A1 * | 1/2007 | Kitahara et al. | ..... | 368/255 |

OTHER PUBLICATIONS

Laconi Radio Controlled Watch Instruction Manual (English: pp. 19-35).

* cited by examiner

*Primary Examiner* — Sean Kayes
(74) *Attorney, Agent, or Firm* — Carmody & Torrance LLP

(57) ABSTRACT

A wearable electronic device of the type wherein information is conveyed in an analog manner at least in part by the use of at least one display hand, wherein the wearable electronic device includes a dial having a dial side and an opposite side, wherein the display hand is positioned on the dial side of the dial, wherein the wearable electronic device comprises among other things, a casing having a frontside and a backside, wherein the dial is viewable from the frontside thereof; and a digital display, operatively coupled to a controller assembly, wherein the digital display displays at least mode specific informational indicia and is viewable only from the backside of the device; at least one actuator, operatively coupled to the controller assembly, for changing the mode specific informational indicia displayed on the digital display; and wherein the controller assembly causes the mode specific informational indicia displayed on the digital display to be thereafter reflected in the information displayed in the analog manner by the at least one display hand.

20 Claims, 14 Drawing Sheets

| | |
|---|---|
| PB1 pressed | PULL CROWN TO SET1 |
| Crown at Set1 | LEAP YEAR = 3 ⊢ SET2 |
| Crown at Set2 | SET LEAP YEAR ⊢ PB1 |
| PB1 pressed | LEAP YEAR = 4<br>CONFIRM PB2 |
| PB2 pressed | SET MONTH = 11 ⊢ PB1 |
| PB1 pressed | MONTH = 2<br>CONFIRM PB2 |
| PB2 pressed | SET DATE = 20 ⊢ PB1 |
| PB1 pressed 2x | DATE = 22<br>CONFIRM PB2 |
| PB2 pressed | SET TIME ⊢ TURN CROWN |
| crown turned | CONFIRM AM-TIME ⊢ PB1<br>CONFIRM PM-TIME ⊢ PB2 |
| PB1/PB2 | PUSH CROWN IN |
| crown pushed in | MODE SELECT<br>PRESS PB1 |
| | SET ALARM |
| | ... |
| | SET SECOND TZ |
| | ... |

*FIG. 9*

WEARABLE ELECTRONIC DEVICE WITH SECONDARY DIGITAL DISPLAY

BACKGROUND OF THE INVENTION

The present invention is directed generally to wearable electronic devices of the type wherein information is conveyed in an analog manner by one or more display indicators, such as for example and not limitation, display hands, and in particular, to a wearable electronic device that also includes a digital display, viewable only from the backside of the device in a preferred embodiment, wherein the digital display displays at least mode specific informational indicia that is changeable, and wherein the mode specific informational indicia displayed on the digital display is thereafter reflected in the information displayed in the analog manner by the at least one display hand. Specifically, it is the controller assembly that causes the mode specific informational indicia displayed on the digital display to be thereafter reflected in the information displayed in the analog manner by the at least one display hand. The present invention is also directed to a methodology of displaying information in an analog manner by the use of display indicators, such as one or more display hands or rings.

Ideas to assist users in setting and/or calibrating a wearable electronic device, such as a wristwatch, are broad and varied. For example, in watches commonly referred to as "digital" watches, actual printed text may be provided along the bezel of the device (or on the display itself) to prompt users through a setting and/or calibration sequence.

In "analog" watches, the idea of printing on the watch bezel is less than desirable, and may even be less than practical since limited information, if any at all, can be provided on the bezel itself while still remaining aesthetically pleasing. Therefore, a perceived deficiency in the prior art is the ability to provide a user with easy to remember steps for setting/calibrating displayable information in an electronic device of the "analog" type.

As such electronic devices become more sophisticated and complicated, designers continue to look for ways to facilitate a user's interaction with the device. One method and construction believed to have advanced the state of the art is set forth in U.S. Pat. No. 7,258,481, the disclosure of which is incorporated by reference as if fully set forth herein. This '481 patent describes and claims, among other things, a method of setting/calibrating at least two display hands in an electronic device by causing the display hands to separately rotate thereby informing the user as to the next display hand ready to be set and/or calibrated. The method and construction set forth in the foregoing '481 patent is one example of an interface that assists the user through a setting/calibration sequence for a plurality of display hands in an electronic device.

Another known prior art device is a radio controlled watch made by Lacher. This device includes conventional hands to convey time in an analog manner along with a separate two-digit digital display also visible only when viewed from the dial side of the watch. Examples of use of this device include the ability of a user to adjust the time for a different timezone when traveling therebetween. In such a sequence, actuation of a side pusher permits a user to input and visibly see in the frontside mounted digital display a desired number of hours offset between New York and Germany. For example, a watch otherwise displaying 10:10 by the hour and minute hands can be changed to 4:10 by actuation of a side pusher so as to display the number "6" (representing for example the number of hours difference between New York and Germany) on the digital display. After a 5 second delay the display hands move so as to display the time in Germany.

However, it is believed that as electronic devices, such as and in particular, wearable electronic devices such as timepieces by example and not limitation, become more versatile and the functionality more flexible, additional features and methodologies will be desirable for still further maintaining and/or improving the ease by which users interface with the devices.

For example, the aforementioned Lacher device suffers from at least two perceived deficiencies. First, the space provided by the digital display is inadequate to convey sufficient information to the user, such as the ability to display both mode information and specific button sequencing/actuation to the user. Secondly, providing the digital display on the front of the watch limits both spacing availability and decreases aesthetics.

It is thus believed that further advances to the state of the art are both desirable and achievable. In particular, it is believed that it would be desirable to provide users with an ability to more easily set/calibrate and/or understand the setting/calibrating sequence for a plurality of display hands in an electronic device of the "analog" type. Specifically, there is a need to provide an interface that prompts and/or assists the user through a setting/calibration sequence for a plurality of display indicators, such as display hands or rings in an electronic device, preferably of the wearable type, while simultaneously achieving the foregoing in both an increased functional and aesthetic manner.

SUMMARY AND OBJECTIVES OF THE INVENTION

It is thus an objective of the present invention to overcome the perceived deficiencies in the prior art.

Specifically, it is an objective of the present invention to provide a user with an improved interface for setting and/or calibrating display indicators, such as display hands and/or rings in one or more modes in an electronic device.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, a preferred embodiment of the present invention is, generally speaking, directed to a wearable electronic device of the type wherein information is conveyed in an analog manner at least in part by the use of at least one display hand, wherein the wearable electronic device includes a dial having a dial side and an opposite side, wherein the display hand is positioned on the dial side of the dial, wherein the wearable electronic device comprises a casing having a frontside and a backside, wherein the dial is viewable from the frontside thereof; an actuation mechanism positioned on the opposite side of the dial and operatively coupled to the at least one display hand, for rotating the at least one display hand in at least one of a clockwise and counterclockwise direction in predefined increments; a controller assembly, operatively coupled to the actuation mechanism, for causing the actuation mechanism to rotate the at least one display hand in at least one of the clockwise and counterclockwise directions in the predefined increments; a digital display, operatively coupled to the controller assembly, wherein the digital display displays at least mode specific informational indicia, wherein the digital display is positioned to be viewable only when viewing the backside of the casing of the wearable electronic device and the at least one display hand is positioned to be viewable only when viewing a frontside of the casing; and at least one actuator, operatively coupled to the controller assembly, for changing the mode specific informational indicia displayed on the digital display; and wherein the controller assembly causes the mode specific informational indicia displayed on the digital display to be thereafter reflected in the information displayed in the analog manner by the at least one display hand.

In an alternative but still preferred embodiment, the digital display is configured as a "solid state analog" display as shown in U.S. Pat. No. 3,950,078, the subject matter of which is incorporated by reference as if fully set forth herein. This configuration, depicting the hands of an analog watch using a segmented digital display, allows the setting mechanism to "mirror" the positions of the display hand.

In a preferred embodiment, the electronic device is a timepiece in the form of a wristwatch.

BRIEF DESCRIPTION OF THE DRAWINGS

The above set forth and other features of the invention are made more apparent in the ensuing Description of the Preferred Embodiments when read in conjunction with the attached Drawings, wherein:

FIG. 9 is an exemplary partial user interface sequence in accordance with a preferred embodiment of the present invention.

Identical reference numerals in the figures are intended to indicate like parts, although not every feature in every figure may be called out with a reference numeral.

DETAILED DESCRIPTION OF THE PREFERRED EMBODIMENTS

Figure 1:
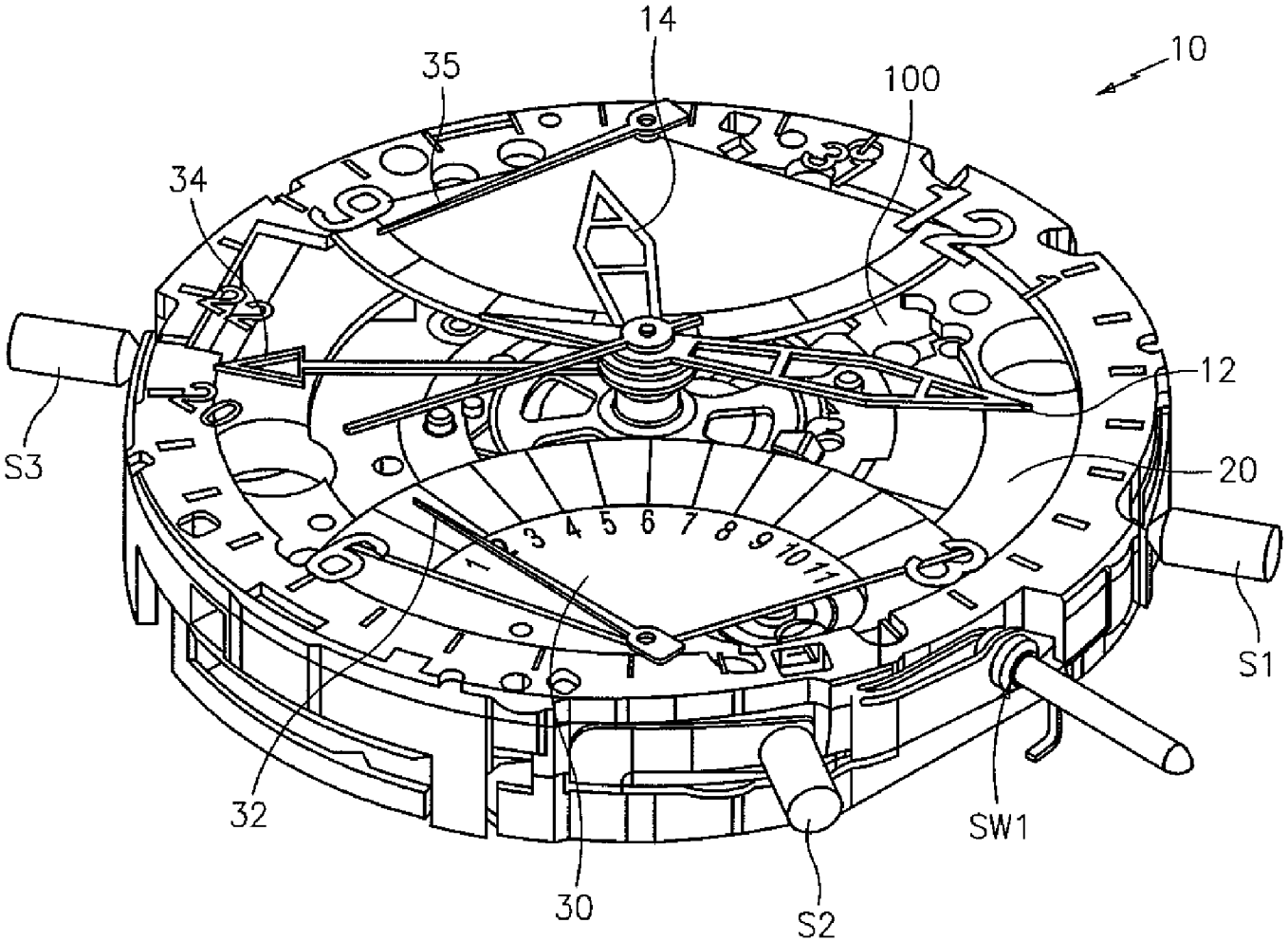
FIG. 1 is a perspective view from the dial side of a wearable electronic device in accordance with a first embodiment of the present invention, illustrating an exemplary snapshot in time, and illustrating among other things, multiple display hands.

The present invention is directed to an electronic device that is operable in at least one mode, and preferably operable in a plurality of modes, such as by way of example and not limitation, a plurality of setting modes, such as a time setting mode, a month setting mode, a date setting mode, a leap year setting mode, a day setting mode and a year setting mode, just to name a few. Thus, it can be seen that in accordance with a first embodiment of the present invention, the electronic device may be a timepiece having the configuration and construction as set forth in the figures by way of example and not limitation. The wearable electronic device may be a timepiece such as a wristwatch, and thus may comprise other features and parts, namely for example and not limitation, a wrist strap (not shown) for securing the electronic device to a wrist.

However and/or alternatively, the electronic device may be in the form of and/or have in additional to timekeeping functionality, functionality related to altitude, temperature or compass measurements, barometric pressure, heart rate display, blood pressure (and/or combinations thereof), the display of tide information such as whether the tide is high or low, sunset information, moon phases, medical information such as when medicine should be taken and how many pills at each time interval, a count-down timer, or any one of additional parameters such as water pressure, water depth and oxygen left in a diver's tank (i.e. a diver's watch); object finder (i.e. to find one's car or way back to a starting location); blood/sugar levels (a glucometer); speed and distance (a runner's watch); displaying how much money is in a debit account; and any combination of the foregoing, all of which may be in addition to or in the absence of conventional timekeeping functionality. In a preferred embodiment and that illustrated in many of the figures, the electronic device may have the configuration of what would be understood in the art as a chronograph watch, but this is by example and not limitation.

Many details applicable to the present invention may be found in coowned U.S. Pat. No. 6,896,403 ("Mode Selecting Assembly For A Timepiece"); U.S. Pat. No. 7,120,091 ("Electronic Device With Calendar Function"); U.S. Pat. No. 7,113,450 ("Wearable Electronic Device With Multiple Display Functionality"); U.S. Pat. No. 7,027,361 (Perpetual Calendar For a Timepiece"); U.S. Pat. No. 7,027,362 ("Multifunctional Rotating Ring in a Timepiece"); and U.S. Pat. No. 7,023,762 ("Date Display Assembly for an Analog Timepiece"), as well as coowned published application No. WO 2006/134171, the subject matters of which are fully incorporated by reference as if each one were fully set forth herein.

For example, the present disclosure omits, for purposes of brevity, certain basic and very well known concepts regarding the construction of an analog timepiece. For example, the basic construction and arrangements of gears and/or gear trains to rotate a plurality of "standard" hands all supported on a center stem, such as an hour hand, a minute hand and a "seconds" hand, are omitted as being well within the purview of one skilled in the art, as are details for ring rotations, such as for the date by way of example, as illustrated herein and as further disclosed in the aforementioned patents. Likewise, the known construction and arrangements of gears and/or gear trains to design a chronograph watch will likewise be omitted as being well within the purview of one skilled in the art.

Figure 2:
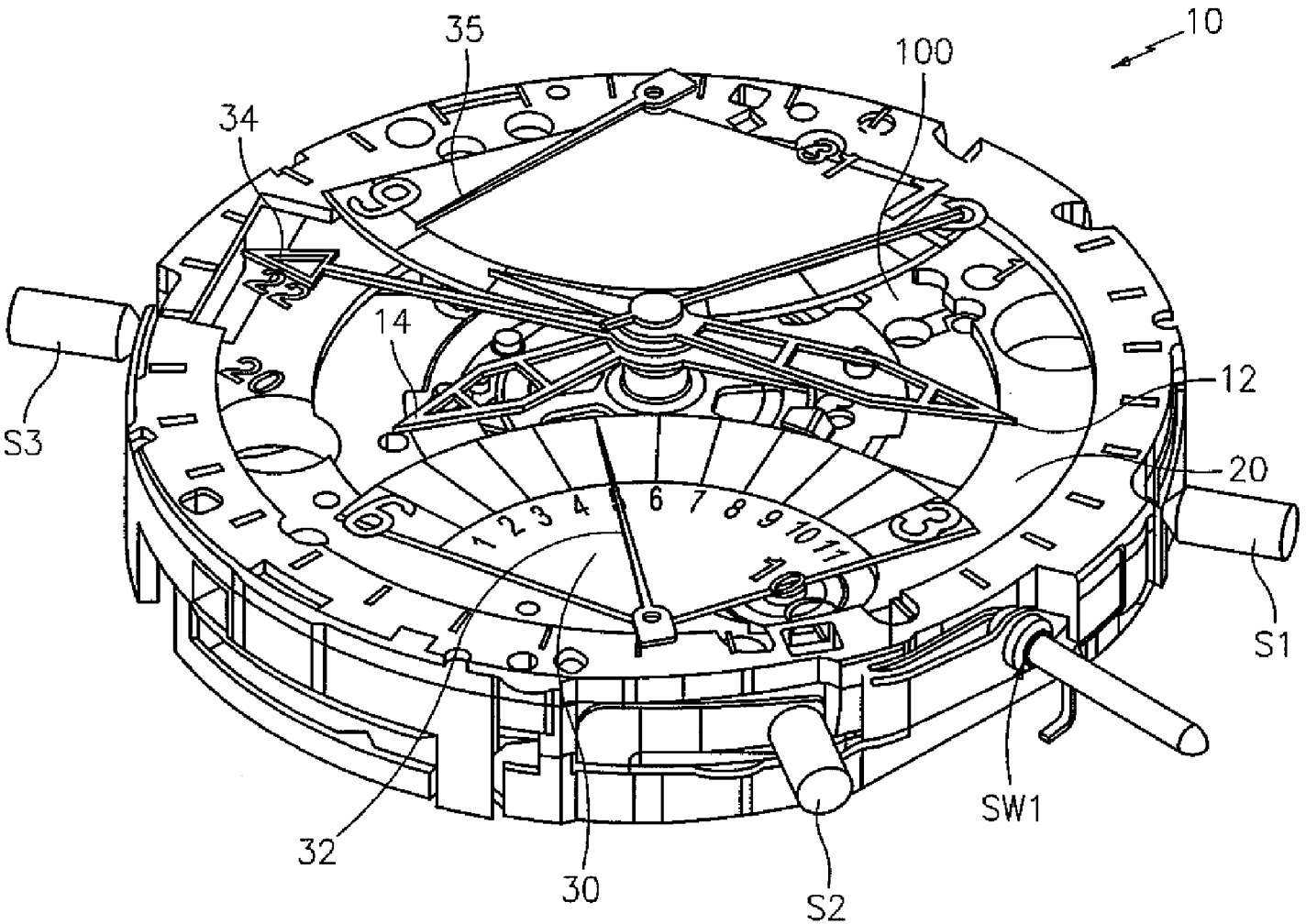
FIG. 2 is a perspective view from the dial side of the wearable electronic device in accordance with the first embodiment of the present invention, illustrating among other things, the date hand having been advanced to illustrate another date and the hour and minute hands having been rotated to illustrate the conveyance of differing information by the display hands.
Figure 3:
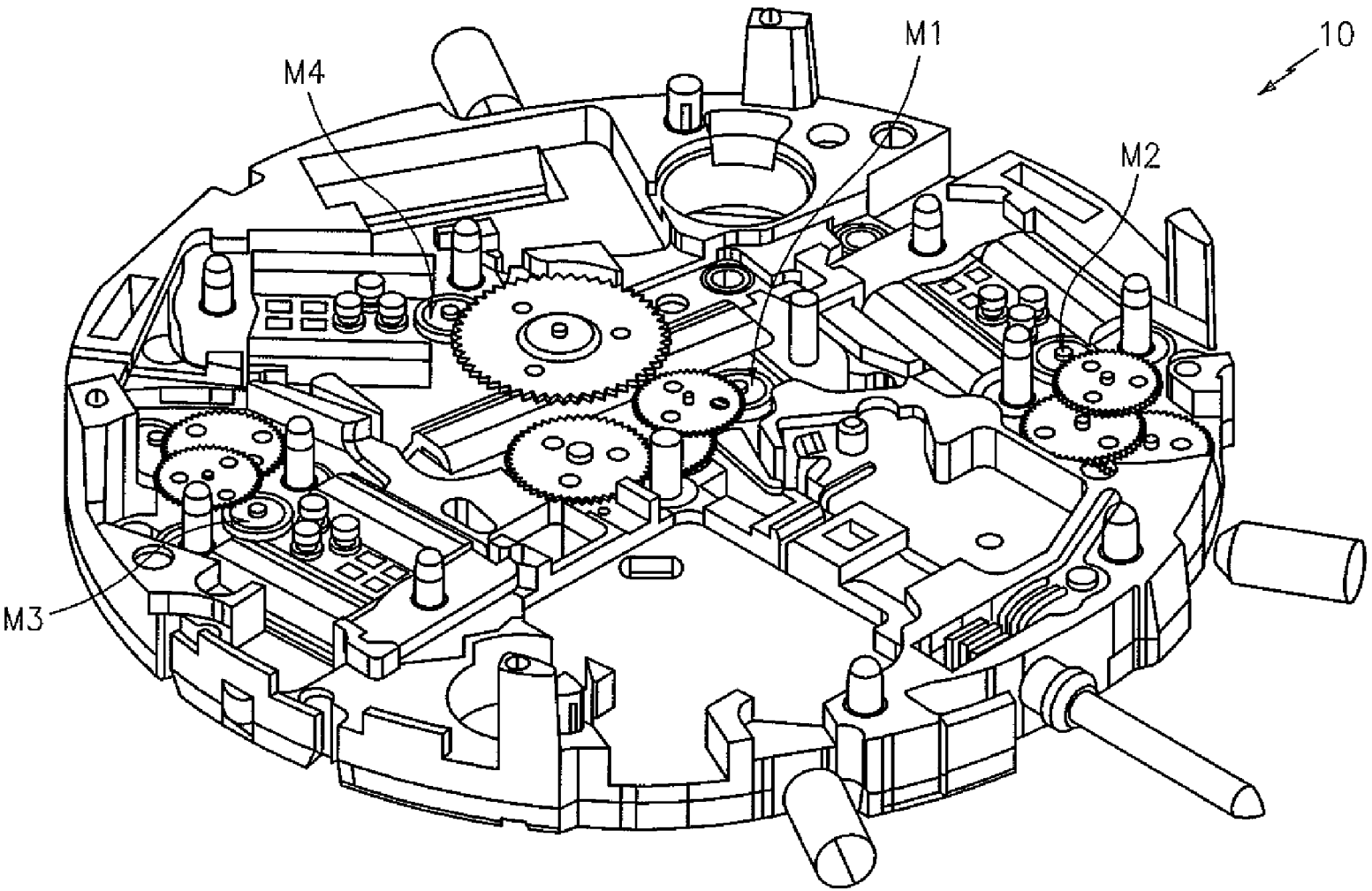
FIG. 3 is a perspective view of a movement assembly for a wearable electronic device constructed in accordance with the first embodiment.

Reference is thus first made generally to FIGS. 1-3, which illustrates a module generally indicated at 10 and constructed in accordance with a first embodiment of the present invention. Module 10 is part of a wearable electronic device, which in the first preferred embodiment, is a timepiece having the configuration and construction as set forth in FIGS. 8, 8A by way of example and not limitation. A suitable module for use in all embodiments of the present invention can be found in the aforementioned patents, and in particular, U.S. Pat. No. 7,113,450.

In a completed assembly and to carry out normal (e.g. hour/minute timekeeping, day and date) functionality, module 10 is provided with one or more subassemblies, each of which may comprise at least one actuation mechanism and one or more gears rotatably engaged with the actuation mechanism, wherein actuation of the actuation mechanism causes the rotation of the one or more gears. The preferred actuation mechanisms are stepper motors designated generally in FIG. 3 as M1, M2, M3 and M4 all of which are disposed in module 10. As would be understood in the art, their specific location is one of design choice and dictated by constraints such as spacing, power and torque requirements and the desired positioning of the display hands and/or rings, such as those disclosed in the patents incorporated herein by reference and illustrated in FIGS. 1, 2. As positioned in module 10, the respective motors rotate respective pinions (or rings as the case may be), as would be understood in the art and/or after a review of the patents and application incorporated herein by reference. For the convenience of the reader however, it should be understood that as positioned in the module of a preferred embodiment, motor M1 is provided to rotate at least hour hand 14 and minute hand 12 (and a second hand, as provided) all in a known manner. In a similar manner, hand 32 is rotated by stepper motor M2, and a gear train is provided to convey the rotational activity generated by the rotor of motor M2 to hand 32. Likewise, hands 35 and 34 are each respectively rotated by stepper motors M3 and M4, and respective gear trains may be provided to convey the rotational activity generated by the respective rotors of motors M3 and M4. The construction of the respective gear trains are well within the purview of one ordinarily skilled in the art.

A controller assembly provides the proper and accurate controlling, positioning and rotation of the one or more display hands and/or any rings, such as a date ring by way of example and not limitation. Details of a controller assembly, generally indicated at 100 in FIGS. 4 and 5, can likewise be found in many of the aforementioned patents (e.g. U.S. Pat. No. 7,113,450) with reference to controller 100 therein, and the controller assembly of the present invention preferably comprises all of the functional features described therein to carry out the objectives and features of the present invention. The added functionality particular to the present invention shall now be disclosed.

Figure 4:
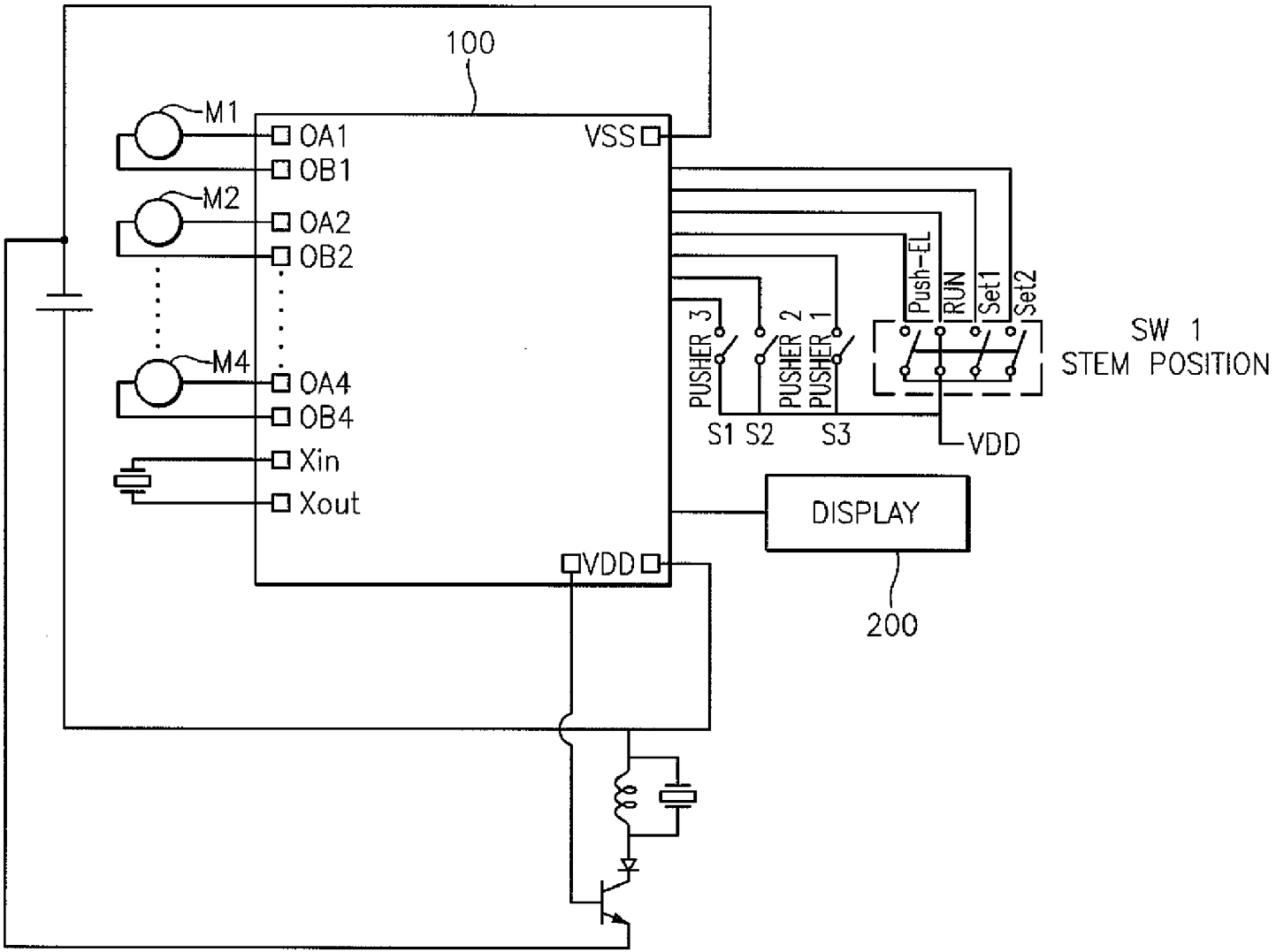
FIG. 4 is a simplified circuit diagram for a wearable electronic device constructed in accordance with the present invention.
Figure 5:
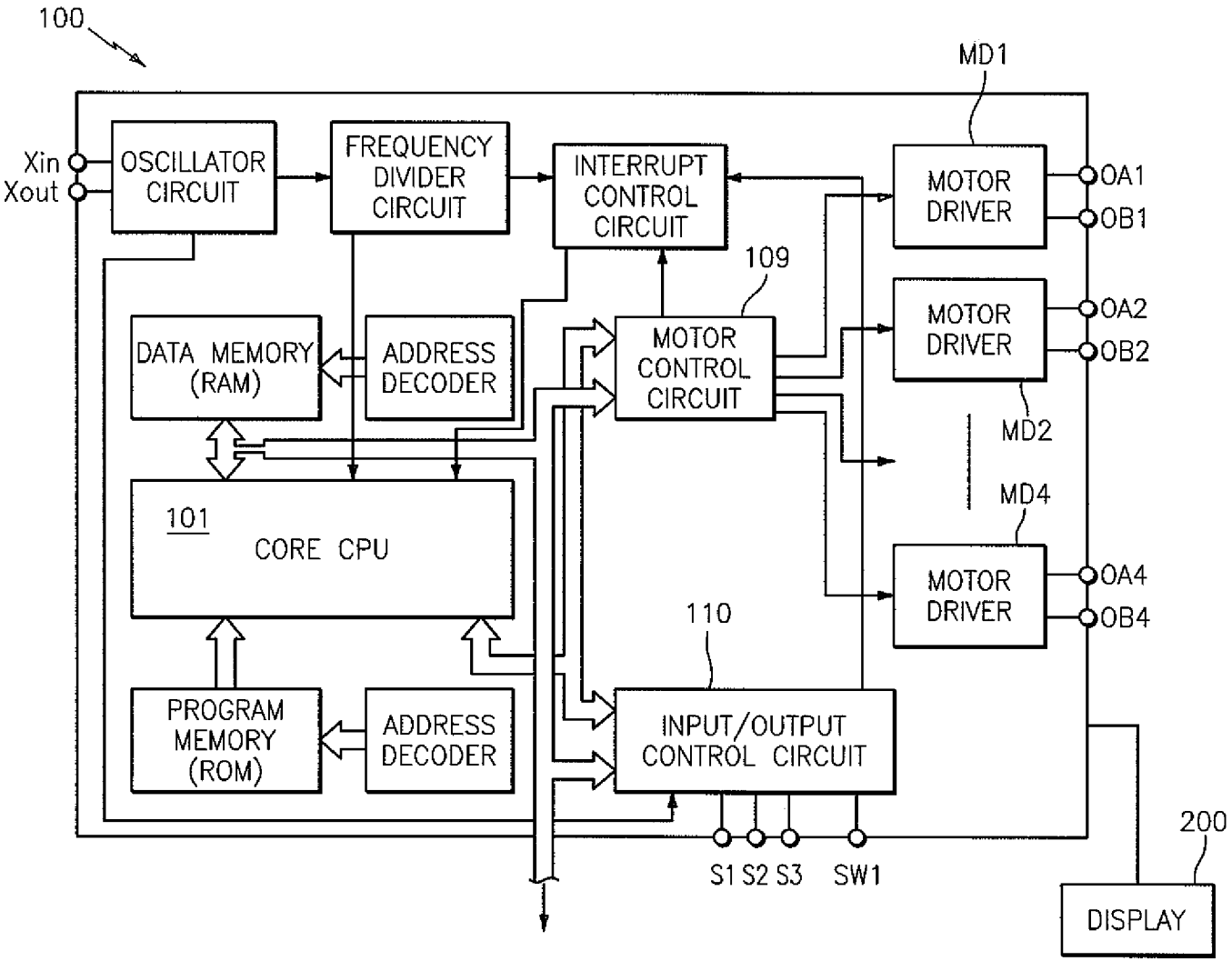
FIG. 5 is a block diagram of a controller for use in a wearable electronic device constructed in accordance with a preferred embodiment of the present invention.

General reference may thus be made to FIGS. 4 and 5 for a block diagram of controller assembly 100, which illustrates among other things, (i) interface connections to motors M1, M2, M3 and M4, (ii) pushers, which are illustrated schematically as switches S1-S3 (or PB1-PB3 as used interchangeably herein), and (iii) a setting stem SW1, which is illustrated as having a plurality of axial positions (e.g. "push-EL," "RUN," "SET1" and "SET2"). However, it is understood that switches S1-S3 and setting stem SW1 are also intended to generically indicate both side/top mounted pushers, as well as side mounted rotatable crowns, and thus respond to the actuation (i.e. pulling and/or pushing) action thereof.

Reference may also be made to FIG. 5 which illustrates a block diagram of controller assembly 100. Particular reference is made to motor control circuit 109, which receives a commanded "next number of pulses" from CPU core 101 and generates the pulsed and phased signals necessary to move a desired motor (e.g. M1-M4) a desired amount and in a desired direction. Pulse outputs of motor control circuit 109 are buffered by motor drivers MD1-MD4 and applied to the respective motors M1, M2, M3, M4.

An input/output control circuit 110 controls the crown/stem SW1 actuations and pushbutton switches S1-S3 of FIG. 4 and provides such signaling information to CPU 101.

In accordance with the invention, a digital display, generally indicated at 200 is also operatively coupled to controller 100. In a preferred embodiment, digital display 200 is a bi-stable electronic cholesteric display (e.g. a cholesteric liquid crystal display) although other types of displays would be known and available to use, as would be understood by those skilled in the art. More specifically, in accordance with a user interface, manual actuation of one or more pushers and/or the axial positioning of the setting stem SW1 will cause selected modes to either be one of displayed and/or cycled about, thus providing the user with the ability to select one or more modes in which the user desires the electronic device to operate. Alternatively and/or in addition, in the preferred embodiment, the digital display displays mode specific informational indicia, such as for example, in a time setting mode, would include such mode specific informational indicia as hours, minutes, seconds, and "a.m." or "p.m." In the preferred embodiment where the digital display is configured as in U.S. Pat. No. 3,950,078 the position of the "hands" of such a display can be immediately understood as hours and minutes. Other mode specific information such as "a.m." or "p.m." would need to be included. In a leap year setting mode, the digital display could display digits from "1" to "4" thus allowing the user to set the year within the leap year cycle. Similarly, the date (i.e. "1" to "31") could be set, as well as the month or day should the electronic device include a month or day ring.

The use of the pushers and/or the crown to change operating modes and mode specific informational indicia which is displayed on display 200 is well-known in the art, as evidenced by the many patents in this area, for example, U.S. Pat. Nos. 4,989,188; 4,783,773; 4,780,864; 4,283,784 and 5,555,226 as well as U.S. Pat. Nos. 6,896,403 and 6,203,190, the subject matter of all of which are incorporated by reference as if fully set forth herein.

Importantly, and in accordance with the present invention, digital display 200 effectively displays mode specific informational indicia similar to many of the digital display timepieces well known in the art. However, in accordance with a first embodiment of the present invention, such mode specific informational indicia displayed on the digital display is thereafter reflected in the information displayed in the analog manner by the at least one display hand. In particular, controller assembly 100 causes the mode specific informational indicia displayed on the digital display to be thereafter reflected in the information displayed in the analog manner by the at least one display hand, by causing the rotation of the at least one display hand in at least one of the clockwise and counterclockwise directions.

That is, controller assembly 100, knowing the mode and/or the mode specific informational indicia (e.g. hour, minute, month, date, day, a count up or down timer, etc.) appearing on digital display 200 as well as the position of the rotors for the respective motors M1-M4, causes the respective actuation mechanism(s) to rotate so that the selected display hand and/or the ring, as the case may be, could move or otherwise rotate the appropriate amount. Moreover, the hand and/or ring calibration methodologies disclosed in the aforementioned patents also assist in ensuring that the hands and/or ring are accurately positioned to display information that is reflected by the mode specific informational indicia displayed on the digital display.

Reference is thus made briefly to FIGS. 1 and 2 to illustrate an example of the advantages provided by the present invention. Specifically, a comparison of FIG. 1 to FIG. 2 will make readily apparent that the time displayed by hour hand 14 and minute hand 12 has been changed from 10:09 to 6:09. In keeping with the consistent language of the claims, it can be seen that the information conveyed by hands 12, 14 in FIG. 1 is 10:09 while the information conveyed by hands 12, 14 in FIG. 2 is 6:09.

In accordance with an exemplary sequence, this change may be effectuated by first selecting the TIME mode (if the electronic device has no more than one mode (i.e. only a TIME mode, than no mode selection is necessary) on the digital display. This ability to provide for a selection of a desired mode is well within the purview of one skilled in the art, and may involve for example, pulling the setting stem SW1 to a "SET" position from its normal "RUN" position. Next, the mode specific information indicia, which in this example is the hours, may be selected. For example, the "hours" (e.g. "10") may begin flashing on display 200. Next, actuation of a pusher (e.g. S1, S2 and/or S3), as would be well known in the art would cause the "10" digit to cycle around until the "6" digit was displayed).

In accordance with a preferred user interface, returning the setting stem from a first axial (i.e. "SET") position to a second axial (i.e. "RUN") position, controller assembly 100 causes the mode specific informational indicia displayed on the digital display (i.e. "6") to be thereafter reflected in the information displayed in the analog manner by the at least one display hand (e.g. hour hand 14). In the illustrated case, this can be achieved in one of several ways, namely, in a fast set mode the hour hand 14 can rotate (e.g. clockwise) until it reaches its desired position (i.e. FIG. 2) or minute hand 12 can rotate 360° eight times as would be known in the art until the selected time of 6:09 is displayed. Again, control of the position of hands 12, 14 by controller assembly 100 "knowing" the position of the rotors allows for this advantageous feature.

A similar result can be achieved in display 30, which may be a COUNTDOWN TIMER indicator, by way of example and not limitation. Here again, carrying out steps similar to that described above will cause the mode specific informational indicia displayed on the digital display (i.e. "1" in FIG. 1) to be thereafter reflected in the information displayed in the analog manner by the at least one display hand (in this case display hand 32) in FIG. 2 (i.e. "5"). To be sure, in this exemplary COUNTDOWN TIMER mode, the user interface may be such that the mode specific information indicia change (i.e. minutes="1" to minutes="5") can occur first by selecting and changing the minutes or, in an alternative embodiment, one can merely just cycle through an incrementing display, as disclosed in U.S. Pat. No. 6,203,190. Thereafter, returning the setting stem SW1 from the (i.e. SET) position to the "RUN" axial position will permit controller assembly 100 to cause the mode specific informational indicia displayed on the digital display (i.e. "5") to be thereafter reflected in the information displayed in the analog manner by the at least one display hand (e.g. hand 32) of FIG. 2.

A similar methodology may be used to advance a date ring (such as that shown in FIGS. 10, 11), wherein the controller controls the rotation of the actuation mechanism (e.g. stepper motor) associated with the date ring. Preferable embodiments to carry out the date ring construction are disclosed in U.S. Pat. No. 7,120,091 ("Electronic Device With Calendar Function"); U.S. Pat. No. 7,027,361 (Perpetual Calendar For a Timepiece"); U.S. Pat. No. 7,027,362 ("Multifunctional Rotating Ring in a Timepiece"); and U.S. Pat. No. 7,023,762 ("Date Display Assembly for an Analog Timepiece").

In another typical example, a user may have removed and replaced the battery. Hence, some (if not all) of the information (e.g. time, e.g. hours and minutes, date, alarm) to be conveyed by the display indicators (e.g. display hands and/or date ring) must be "updated" to the correct (e.g.) time, date.

Therefore, by way of example, FIG. 9 illustrates an exemplary actuation sequence to set the year, month, date and time, with specific reference made to the updating of the date and time. For example, actuation of PB2 (i.e. S2) may act as an "enter" or "accept" button. That is, actuation of PB2 may prompt a user to move from one indicator (e.g. leap year) to another (e.g. date). In this exemplary user interface sequence, pressing PB2 at step 30 will initiate the calibration sequence for the date. As indicated in step 35, the user is provided with the current month (e.g. "1" (i.e. January)). Actuation of PB2 may permit the user to accept January as the correct/current month. However, as illustrated in step 40, actuation of PB1 increments the month value (e.g. "1"→"2"). In this case, the exemplary sequence is to be interpreted that the current month is February (were the electronic device to include a month ring and window, the month display could be updated in a consistent manner). Actuation of PB2 in step 45 accepts February as the updated/current month and prompts the display and user interface sequence to set/calibrate the date. Here, as illustrated in step 45, the then current date of the month is "20." Repeated actuation of PB1 (step 50) will increment the date value from the "$20^{th}$" (see FIG. 1) to the "$22^{nd}$" (see FIG. 2). In particular, the date value incremented from "20"→"22". Again, actuation of PB2 in step 55 accepts the $22^{nd}$ as the updated/current date and prompts the display and user interface sequence to set/calibrate the time. It may be at step 55 that the controller assembly 100 causes the mode specific informational indicia displayed on the digital display to be thereafter reflected in the information displayed in the analog manner by the at least one display hand 34.

Step 55 next indicates that rotation of the crown (i.e. stem SW1) will allow the digital time to be adjusted. A user interface for this may be seen from the disclosure of the aforementioned U.S. Pat. No. 6,203,190. Thereafter, actuation of PB1 may be used to indicate "AM" while actuation of PB2 may be used to indicate "PM" (step 60).

Thereafter, pressing the crown in (step 65) may be used to place controller assembly 100 into the normal "RUN" mode while also causing the mode specific informational indicia displayed on the digital display to be thereafter reflected in the information displayed in the analog manner by the at least one display hand. That is, FIGS. 1 and 2 illustrate how the hand 34 was rotated so as to indicate that the date was changed from the $20^{th}$ to the $22^{nd}$ and the time was changed from "10:09" to "6:09."

Figure 10:
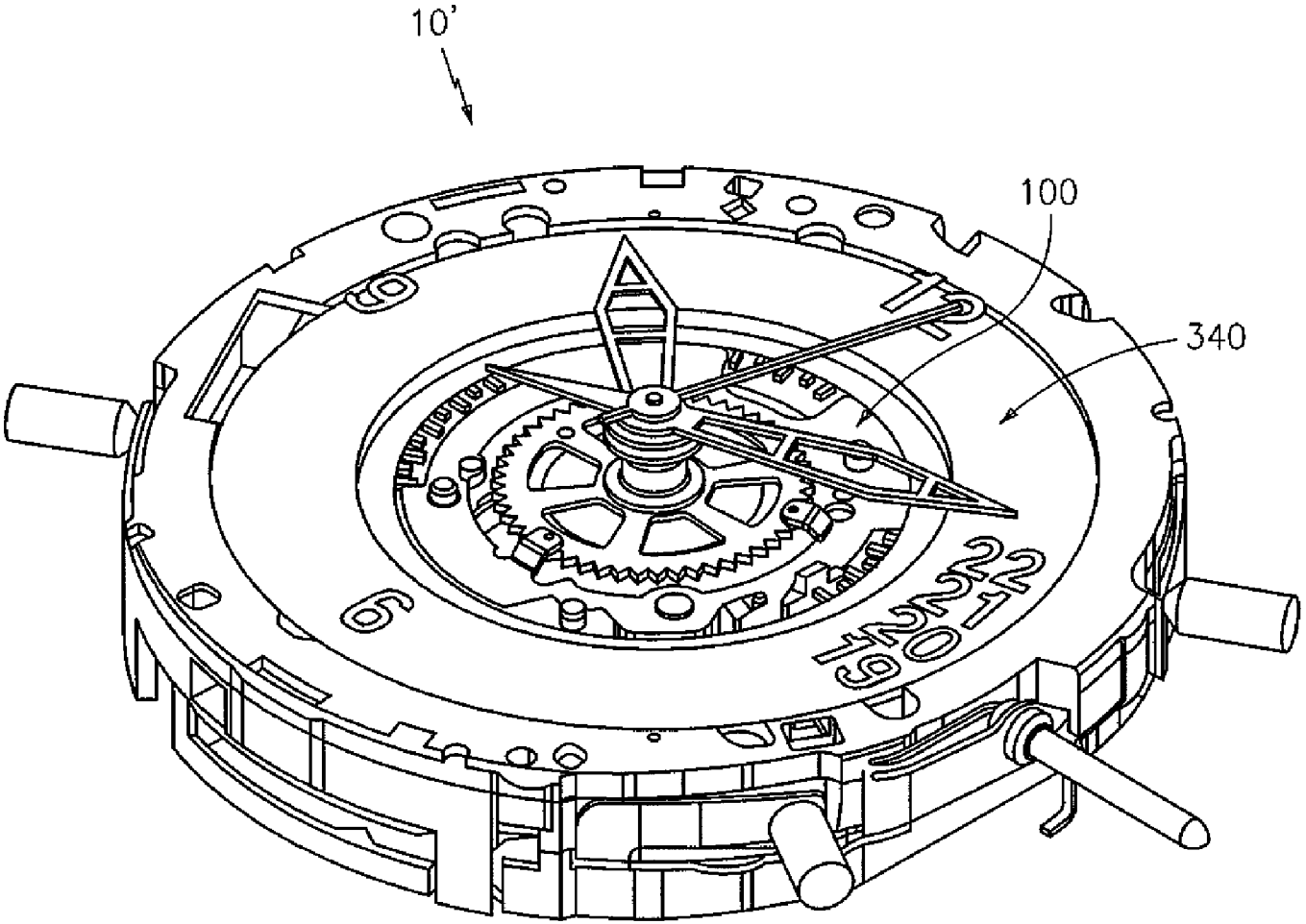
FIGS. 10 and 11 are perspective views of a slight alternative embodiment that incorporates the present invention in connection with a display indicator such as a ring, and a date ring in particular, but this is by way of example and not limitation.
Figure 11:
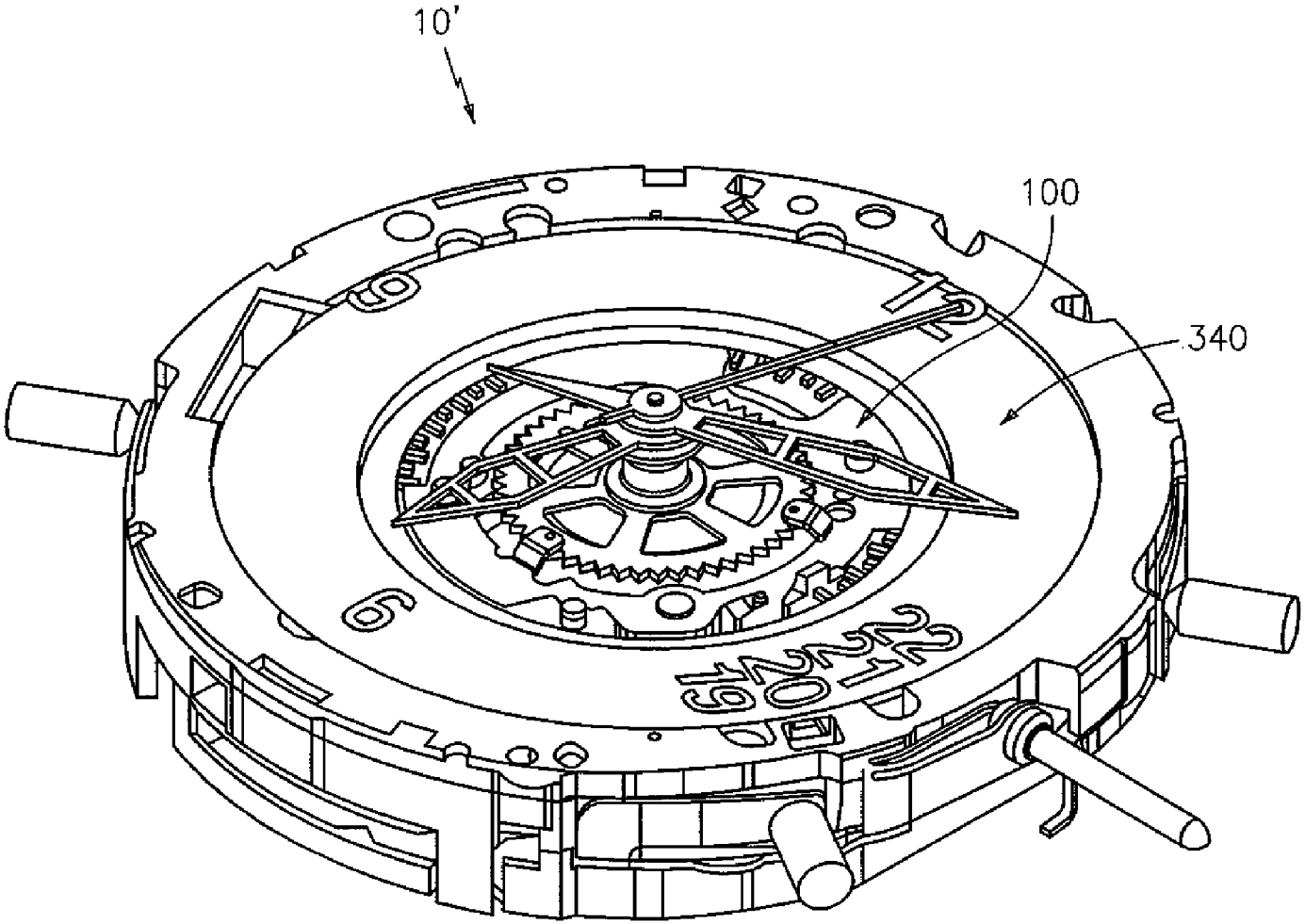

In a slightly alternative embodiment, a date ring for displaying the date can also be used, and reference is made briefly to FIGS. 10, 11 for an illustration thereof. Specifically, FIG. 10 illustrates module 10' with an exemplary position of a typical date ring 340 configured for a window (not shown) through a dial being positioned at the 3:00 o'clock position. In this FIG. 10, were a window to be shown, the date "20" would be visible therethrough. In accordance with the present invention and consistent with state of the art date ring (or more generically, ring rotating technology, such as that disclosed in coowned and pending application Ser. Nos. 11/174,095 and 11/141,973, the subject matters of both being incorporated by reference as if fully set forth herein), controller assembly 100 causes the mode specific informational indicia displayed on the digital display to be thereafter reflected in the information displayed by the date ring, such as by the rotation of date ring 340 and thus the visible display of the date "22" through the window, were it positioned at the 3:00 o'clock position (by way of example).

Figure 6:
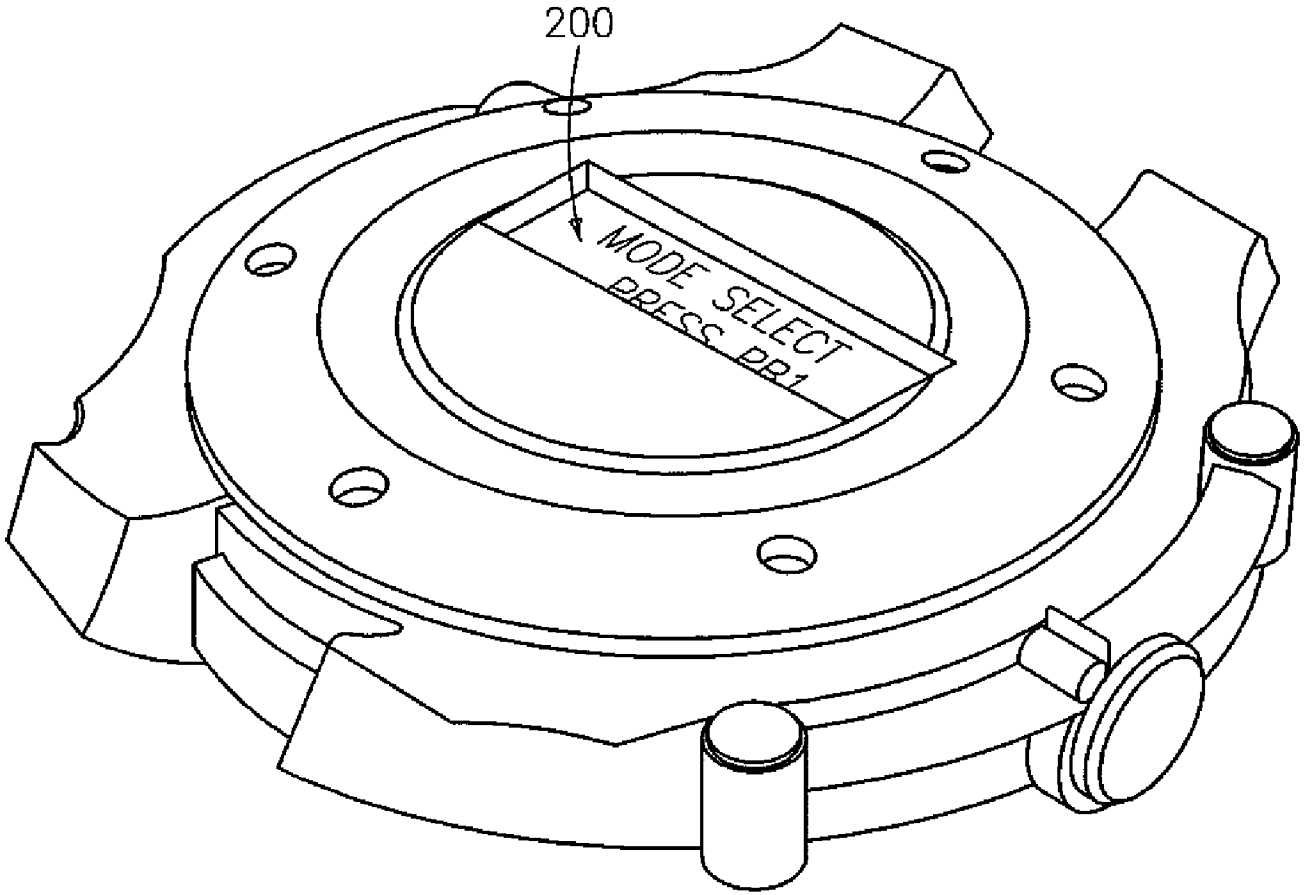
FIG. 6 is a perspective view from the backside of the wearable electronic device of the first embodiment, illustrating an exemplary location of a digital display in accordance with a preferred embodiment of the present invention, namely being mounted in the caseback.
Figure 6A:
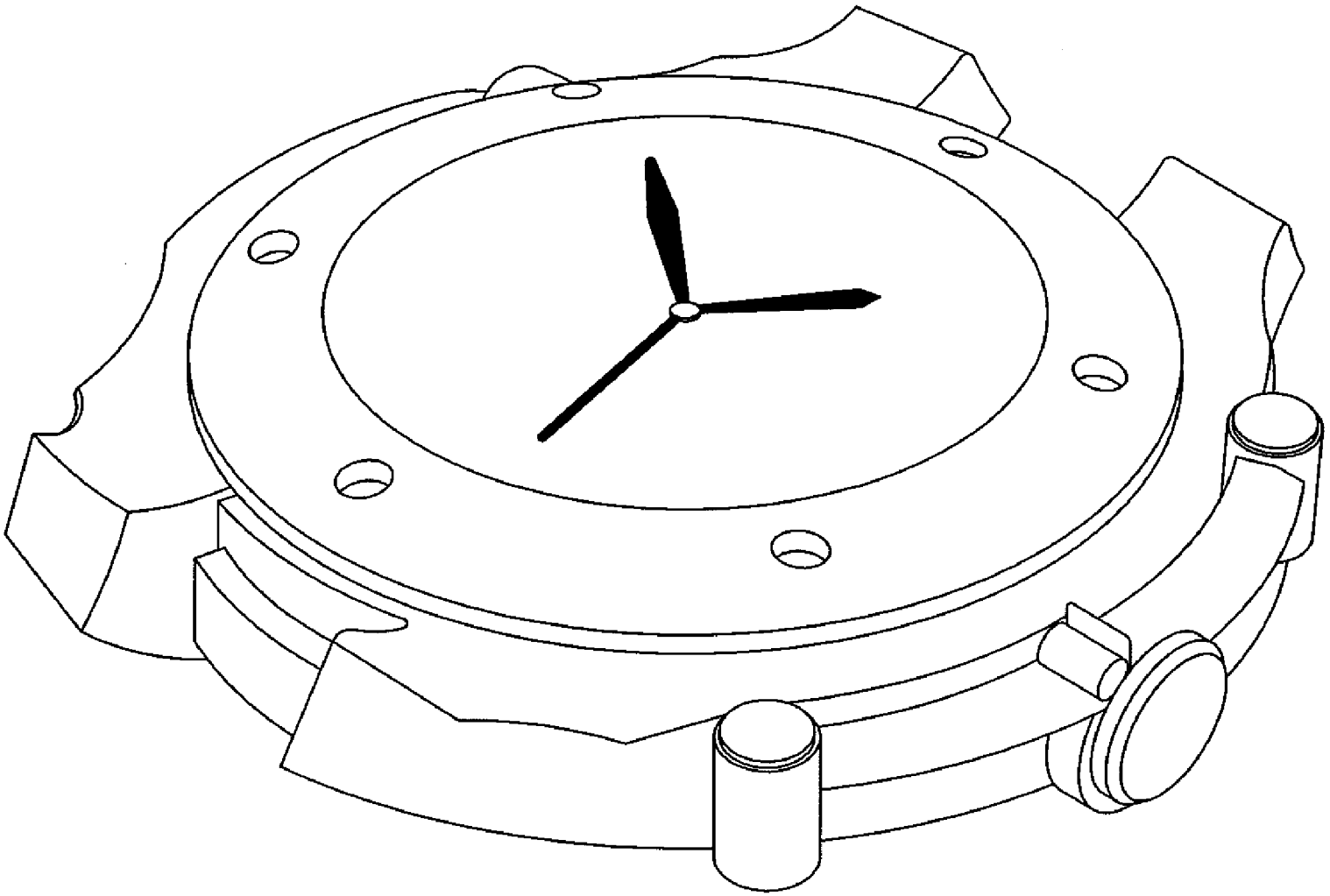
FIG. 6A depicts the same view as FIG. 6, but with the digital display configured in the manner of U.S. Pat. No. 3,950,078—showing analog hands.

FIG. 6 illustrates the wearable electronic device of a first embodiment from the backside illustrating an exemplary and preferred location of digital display 200 being mounted in the caseback. As illustrated, the digital display may also facilitate the setting, changing or calibration of the hands and/or rings by prompting the user with digital text (e.g. "MODE SELECT PRESS PB1").

As thus an additional feature of the present invention, since the wearable electronic device can operate in a plurality of modes by the controller assembly 100 causing the wearable electronic device to operate in each of the plurality of modes, and actuation of the at least one actuator (e.g. the side pushers S1, S2, S3) causes the controller assembly 100 to cycle among and enter each of the plurality of modes (as would be understood from the cited patents incorporated by reference herein), it is advantageous that the digital display 200 can also display mode selecting information related to a sequence for at least one of cycling among and entering each of the plurality of modes (e.g. displaying the information such that pressing pusher PB1/S1 will cause the device to go into mode selection, as but one example). Additional mode selecting information (such as what may be displayed on the display related to the particular modes, and what modes may be available in the first instance) can be found in those patents incorporated by reference herein.

Figure 7:
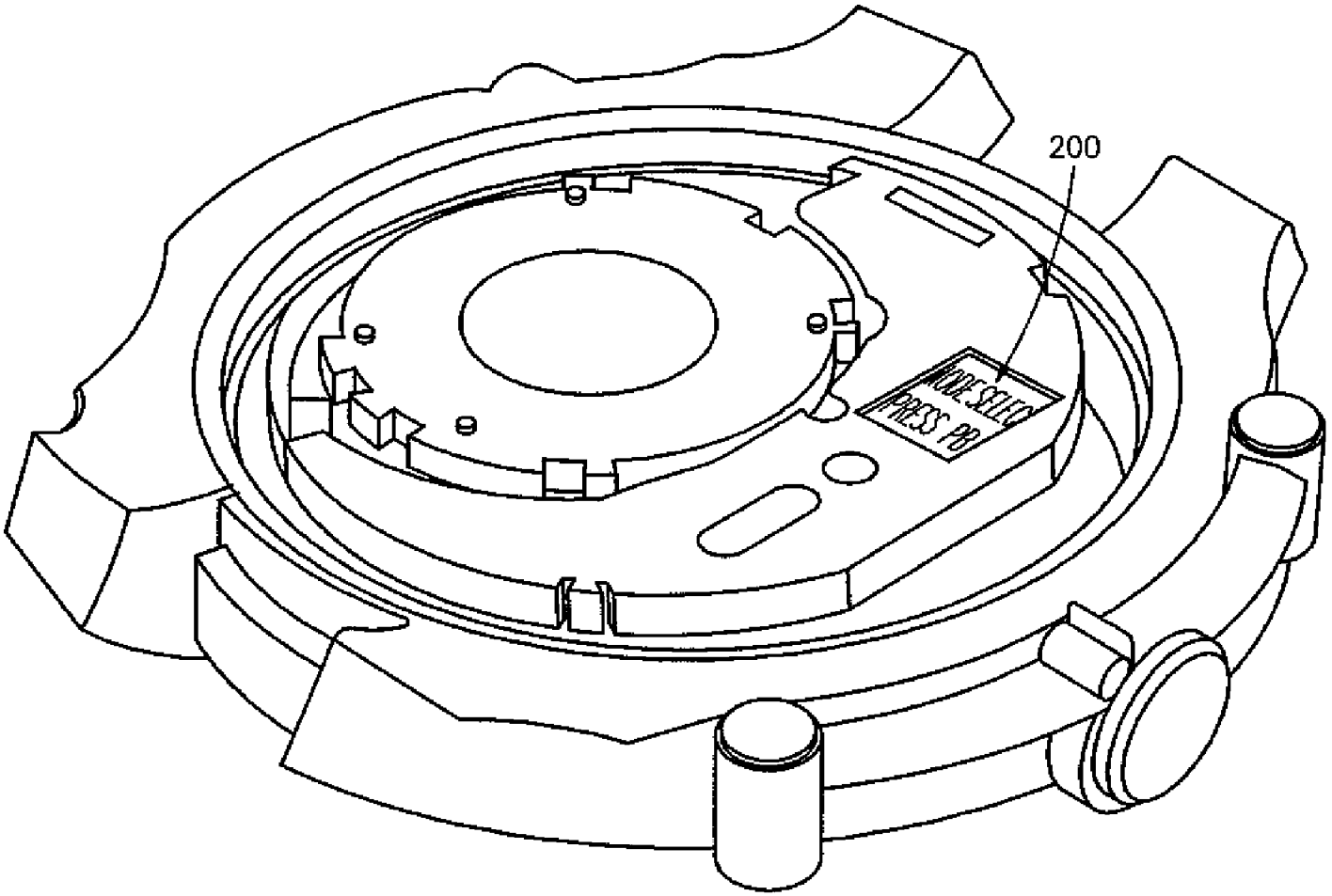
FIGS. 7 and 7A are perspective views of a wearable electronic device constructed in accordance with another preferred embodiment wherein the digital display is mounted on the movement.
Figure 7A:
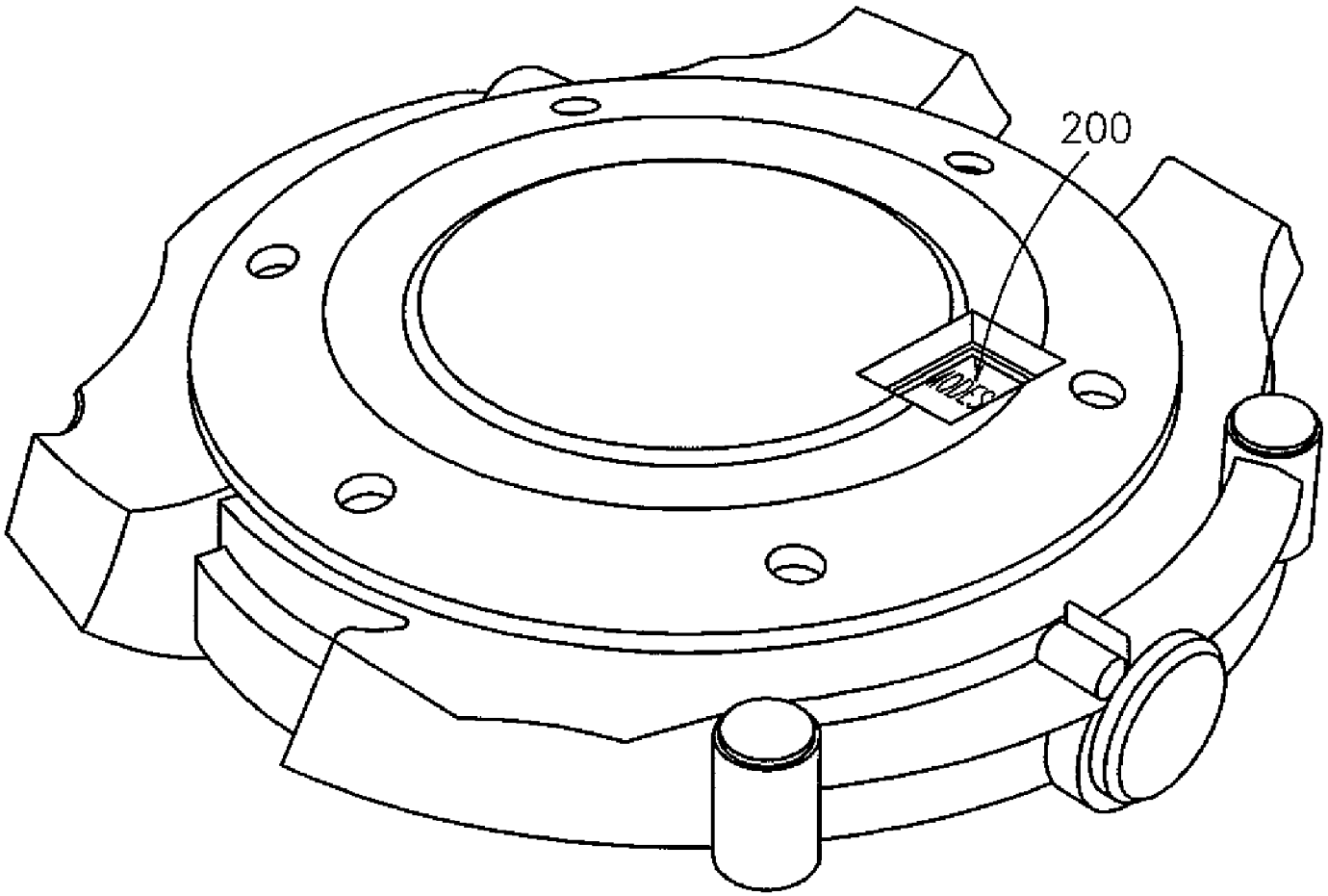
Figure 8:
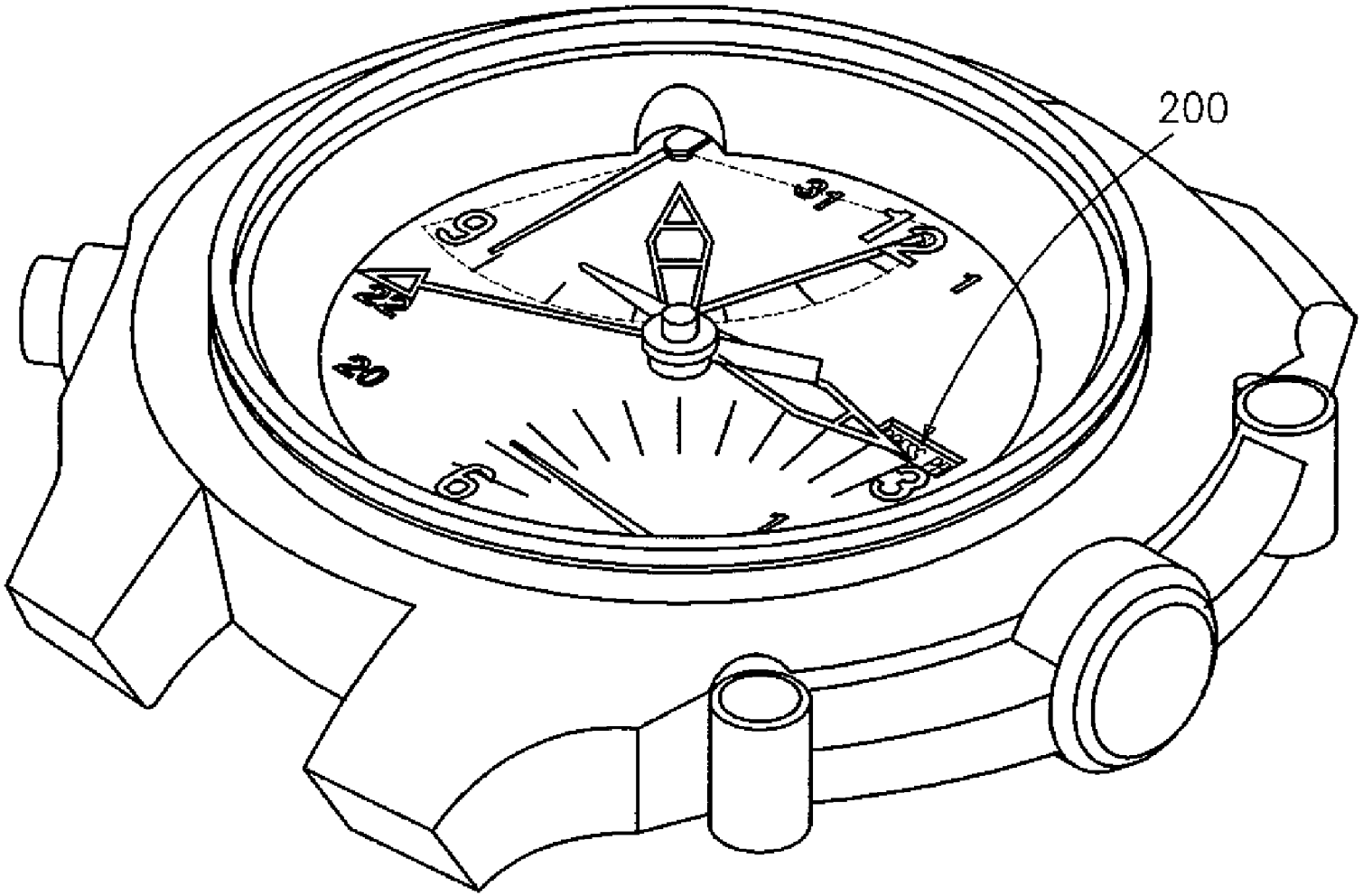
FIG. 8 is a perspective view from the front and dial side of a wearable electronic device in accordance with another preferred embodiment, and in particular, illustrating an alternative position of the digital display, namely being viewable from the front of the electronic device.
Figure 8A:
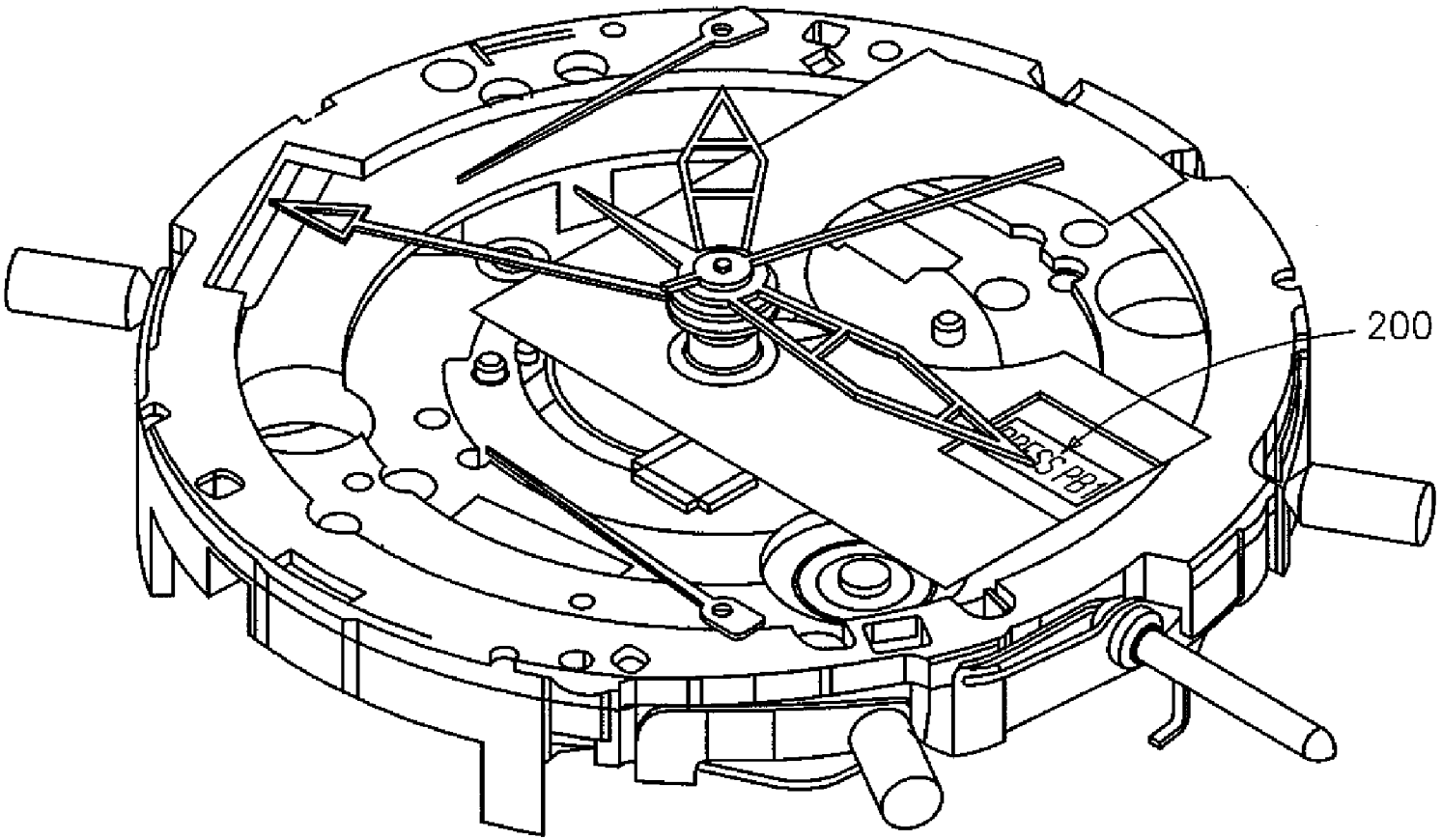
FIG. 8A is a perspective view from the front and dial side of the wearable electronic device in accordance with the embodiment of FIG. 8, with the dial removed to more easily illustrate the position of the digital display.

Slight functionality and aesthetic variations of the present invention are achievable. For example, FIGS. 7 and 7A are perspective views from the back side of a wearable electronic device in accordance with a preferred embodiment, and in particular, illustrating an alternative position of the digital display, namely being viewable from the back and mounted on the movement, while FIGS. 8 and 8A are perspective views of a wearable electronic device in accordance with an alternative embodiment, and in particular, illustrating an alternative position of the digital display, namely being viewable from the front of the electronic device.

The foregoing sequence can be expanded to any number of display hands or rings, and the embodiments in those applications incorporated by reference herein show the wide ranging applicability of the present invention. Particular to the present invention, all that would have to be modified would be the indicators and the controller assembly would have to be modified accordingly. Thus, the present invention provides an alternative method and construction for simply, intuitively and more easily setting/calibrating a plurality of mode specific informational indicia (e.g. date, day, year, month) in an electronic device that is of the "analog" type (i.e. uses rings and/or hands to display information).

Exiting of the setting/calibration mode is likewise facilitated by actuation of a pusher or selected axial displacement of the setting stem back to the "normal" or run position, examples of which can be found in the applications incorporated by reference herein.

In the preferred embodiments, the motors may be bi-directional stepper motors as appropriate, thus being able to rotate in either direction, and the construction of acceptable stepper motors to functionally operate in this manner are widely available and well within the understanding of those skilled in the art. Suitable dials are also well within the purview of the skilled artisan. One skilled in the art would recognize that varying the number of display hands can vary the number of needed stepper motors, all of which is within the scope of the present invention and disclosure and disclosed in those applications incorporated by reference herein.

Although the preferred embodiments provide that controller assembly 100 is highly integrated wherein all timing and display functionality is controlled in controller assembly 100, alternate embodiments could separate the timekeeping functions from those processing and other mode related information, as would be understood by one skilled in the art.

As should also be appreciated by one skilled in the art, the location, position and/or size of the display indicator and/or display hands are merely dictated, for example, by the position of pinions and the position of the respective subassemblies and thus the illustrations herein are shown by example and not limitation.

The gearing ratio to provide for the desirable display rotation or movement of the display hands or rings would be one of design choice depending on the desired or required incremental rotation of the display indicator. Thus the number of wheels in any particular gearing assembly may be more or less than that disclosed herein, and are really one of design choice for the intended function and based upon a number of criterions known to the ordinary designer. Also, the functionality of the controller can be modified to accommodate the varying embodiments disclosed herein by software-programming techniques or differing controllers, both of which is well within the purview of the skilled artisan.

It can thus be seen that the present invention provides for an improved method and construction for setting and/or calibration rings, elongated members and/or display hands. Specifically, the present invention provides an improved user interface for setting and/or calibrating displayable information in one or more modes in an electronic device, that is easy to use and which should be welcome to the user over those arrangements in the prior art.

Moreover, by providing mode selecting information and mode specific information indicia on a digital display as disclosed herein, the user interface becomes much more user intuitive and user friendly. Moreover, by providing the digital display on the back of the device, the limitations of spacing become less of a problem and in fact increases functionality by being able to have more flexibility in the size of the display and thus the amount and type of information displayed thereon. Furthermore, the aesthetics of the device may be perceived to increase as the dial side of the device need not be seen to be encumbered by a visible (and additional) digital display. To be sure, reference to "digital display" herein as well as in the claims covers conventional LCD display as well as those configured as a "solid state analog" display as disclosed and illustrated herein.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

To be sure, the present invention is applicable to a wide variety of devices and applications. That is, while the following embodiments will be disclosed in connection with the setting and/or calibrating of a plurality of modes related to the day, date, month and year, the scope of the invention is not so limiting.

What is claimed is:

1. A wearable electronic device of the type wherein information is conveyed in an analog manner at least in part by the use of at least one display hand, wherein the wearable electronic device includes a dial having a dial side and an opposite side, wherein the display hand is positioned on the dial side of the dial, wherein the wearable electronic device comprises:

a casing having a frontside and a backside, wherein the dial is viewable from the frontside thereof;

an actuation mechanism positioned on the opposite side of the dial and operatively coupled to the at least one display hand, for rotating the at least one display hand in at least one of a clockwise and counterclockwise direction in predefined increments;

a controller assembly, operatively coupled to the actuation mechanism, for causing the actuation mechanism to rotate the at least one display hand in at least one of the clockwise and counterclockwise directions in the predefined increments;

a digital display, operatively coupled to the controller assembly, wherein the digital display displays at least mode specific informational indicia, wherein the digital display is positioned to be viewable only when viewing the backside of the casing of the wearable electronic device and the at least one display hand is positioned to be viewable only when viewing a frontside of the casing; and at least one actuator, operatively coupled to the controller assembly, for changing the mode specific informational indicia displayed on the digital display; and wherein the controller assembly causes the mode specific informational indicia displayed on the digital display to be thereafter reflected in the information displayed in the analog manner by the at least one display hand.

2. The wearable electronic device as claimed in claim 1, wherein the controller assembly causes the mode specific informational indicia displayed on the digital display to be thereafter reflected in the information displayed in the analog manner by causing the rotation of the at least one display hand in at least one of the clockwise and counterclockwise directions.

3. The wearable electronic device as claimed in claim 1, wherein the wearable electronic device can operate in a plurality of modes, wherein the controller assembly causes the wearable electronic device to operate in each of the plurality of modes, wherein the actuation of the at least one actuator causes the controller assembly to at least one of cycle among and enter each of the plurality of modes and wherein the controller assembly causes information related to each of the plurality of modes to be reflected in information displayed in the analog manner and wherein the digital display further displays mode selecting information related to a sequence for at least one of cycling among and entering each of the plurality of modes.

4. The wearable electronic device as claimed in claim 1, comprising:

at least a second display hand for displaying information in an analog manner, wherein the second display hand is positioned on the dial side of the dial, wherein the actuation mechanism is operatively coupled to the at least second display hand;

wherein the first and second display hands convey at least time of day information, and wherein the mode specific informational indicia includes at least one of hours and minutes, and wherein the controller assembly causes the hours and minutes information indicia displayed on the digital display to be thereafter reflected in the time of day information conveyed by the at least first and second display hands.

5. The wearable electronic device as claimed in claim 1, wherein the digital display is an LCD display.

6. The wearable electronic device as claimed in claim 1, wherein the actuation mechanism comprises a stepper motor that itself comprises a rotor, the stepper motor operatively coupled to the controller assembly, for stepping in at least one of a clockwise and counterclockwise direction in predefined increments in response to direction from the controller assembly;

wherein the rotor of the stepper motor is operatively coupled to the at least one display hand, and wherein the rotation of rotor causes the rotation of the at least one display hand in at least one of the clockwise and counterclockwise directions and in the predefined increments.

7. The wearable electronic device as claimed in claim 1, wherein the at least one actuator comprises at least one of (i) a setting stem and (ii) at least one pusher.

8. The wearable electronic device as claimed in claim 1, comprising:

at least a second display hand for displaying information in an analog manner, wherein the second display hand is positioned on the dial side of the dial;

at least a second actuation mechanism positioned on the opposite side of the dial and operatively coupled to the second display hand, for rotating the second display hand in at least one of a clockwise and counterclockwise direction in predefined increments;

wherein the controller assembly is operatively coupled to the second actuation mechanism, for causing the second actuation mechanism to rotate the second display hand in at least one of the clockwise and counterclockwise directions in the predefined increments; and wherein the controller assembly causes the mode specific informational indicia displayed on the digital display to be thereafter reflected in the information displayed in the analog manner by the at least second display hand.

9. The wearable electronic device as claimed in claim 1, wherein the wearable electronic device is a wristwatch.

10. A wearable electronic device of the type wherein information is conveyed at least in part by the use of a display indicator, wherein the wearable electronic device includes a dial having a dial side and an opposite side, wherein the wearable electronic device comprises:

a casing having a frontside and a backside, wherein the dial is viewable from the frontside thereof;

an actuation mechanism positioned on the opposite side of the dial and operatively coupled to the display indicator, for rotating the display indicator in at least one of a clockwise and counterclockwise direction in predefined increments;

a controller assembly, operatively coupled to the actuation mechanism, for causing the actuation mechanism to rotate the display indicator in at least one of the clockwise and counterclockwise directions in the predefined increments;

a digital display, operatively coupled to the controller assembly, wherein the digital display displays at least mode specific informational indicia, wherein the digital display is positioned to be viewable only when viewing the backside of the casing of the wearable electronic device and the display indicator is positioned to be viewable only when viewing a frontside of the casing of the wearable electronic device; and at least one actuator, operatively coupled to the controller assembly, for changing the mode specific informational indicia displayed on the digital display; and wherein the controller assembly causes the mode specific informational indicia displayed on the digital display to be thereafter reflected in the information displayed by the display indicator.

11. The wearable electronic device as claimed in claim 10, wherein the display indicator is an elongated member, wherein the elongated member has provided thereon informational indicia; and wherein at least a portion of the elongated member is viewable through at least one window such that informational indicia corresponding to a mode or scale within which the electronic device is operating is visible in the at least one window, and wherein the rotation of the elongated member changes the informational indicia that is visible in the at least one window as the elongated member rotates in at least one of the clockwise and counterclockwise directions.

12. The wearable electronic device as claimed in claim 11, wherein the wearable electronic device can operate in a plurality of modes, wherein the controller assembly causes the wearable electronic device to operate in each of the plurality of modes, wherein the actuation of the at least one actuator causes the controller assembly to at least one of cycle among and enter each of the plurality of modes and wherein the controller assembly causes information related to each of the plurality of modes to be reflected in information displayed in the analog manner and wherein the digital display further displays mode selecting information related to a sequence for at least one of cycling among and entering each of the plurality of modes.

13. The wearable electronic device as claimed in claim 11, wherein the elongated member is a ring.

14. The wearable electronic device as claimed in claim 1, wherein the mode specific informational indicia is a selectable month.

15. The wearable electronic device as claimed in claim 1, wherein the mode specific informational indicia is a selectable date.

16. The wearable electronic device as claimed in claim 1, wherein the mode specific informational indicia is a selectable leap year indicator.

17. The wearable electronic device as claimed in claim 1, wherein the mode specific informational indicia is a selectable day.

18. The wearable electronic device as claimed in claim 1, wherein the mode specific informational indicia is a selectable year.

19. The wearable electronic device as claimed in claim 1, wherein the mode specific informational indicia is a selectable hour.

20. The wearable electronic device as claimed in claim 1, wherein the mode specific informational indicia is a selectable minute.

* * * * *